US010831124B2

(12) United States Patent
Ozawa

(10) Patent No.: US 10,831,124 B2
(45) Date of Patent: Nov. 10, 2020

(54) INFORMATION PROCESSING APPARATUS AND IMAGE FORMING APPARATUS WITH IDENTIFICATION OF REFLECTIVE SURFACE OF ROTATING POLYGONAL MIRROR

(71) Applicant: CANON KABUSHIKI KAISHA, Tokyo (JP)

(72) Inventor: Manabu Ozawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/563,111

(22) Filed: Sep. 6, 2019

(65) Prior Publication Data

US 2020/0096896 A1 Mar. 26, 2020

(30) Foreign Application Priority Data

Sep. 26, 2018 (JP) ..... 2018-180939

(51) Int. Cl.
*G03G 15/04* (2006.01)
*G03G 15/043* (2006.01)
*G03G 15/01* (2006.01)

(52) U.S. Cl.
CPC ..... *G03G 15/043* (2013.01); *G03G 15/011* (2013.01)

(58) Field of Classification Search
USPC ..... 399/4
See application file for complete search history.

(56) References Cited

U.S. PATENT DOCUMENTS

| | | | | |
|---|---|---|---|---|
| 9,057,975 | B2 * | 6/2015 | Nihei | G03G 15/043 |
| 10,268,137 | B2 * | 4/2019 | Suzuki | G02B 26/0875 |
| 2009/0003862 | A1 * | 1/2009 | Tominaga | G03G 15/326 399/51 |
| 2013/0141510 | A1 | 6/2013 | Araki | G02B 26/124 |

FOREIGN PATENT DOCUMENTS

| | | | |
|---|---|---|---|
| JP | 2004-271691 | | 9/2004 |
| JP | 2006231751 A | * | 9/2006 |
| JP | 2012-137598 | | 7/2012 |
| JP | 2013-117699 | | 6/2013 |

* cited by examiner

*Primary Examiner* — Quana Grainger
(74) *Attorney, Agent, or Firm* — Venable LLP

(57) ABSTRACT

An apparatus identifies reflective surfaces used for scanning a first photosensitive member and a second photosensitive member. A first storage stores correction data corresponding to each of reflective surfaces of a first rotating polygonal mirror. A first correction unit corrects, on a basis of the correction data and information indicating the reflective surface, image data in association with the reflective surface. A second storage stores correction data corresponding to each of reflective surfaces of a second rotating polygonal mirror. A second correction unit corrects, on a basis of the correction data and information indicating the reflective surface, image data in association with the reflective surface.

13 Claims, 11 Drawing Sheets

INFORMATION PROCESSING APPARATUS AND IMAGE FORMING APPARATUS WITH IDENTIFICATION OF REFLECTIVE SURFACE OF ROTATING POLYGONAL MIRROR

BACKGROUND OF THE INVENTION

Field of the Invention

The present invention relates to a technique for identifying a reflective surface of a rotating polygonal mirror.

Description of the Related Art

In electrophotographic image forming apparatuses, a polygon mirror is rotated to reflect laser light at the polygon mirror such that the laser light scans a photosensitive member.

While the polygon mirror has a plurality of reflective surfaces, the lengths of the reflective surfaces in the rotational direction of the polygon mirror can be different from each other, and the inclinations of the reflective surfaces with respect to the rotation axis of the polygon mirror can be different from each other. This is due to the assembly accuracy of the optical system and the cutting accuracy of the polygon mirror during manufacture, and may lead to distortion of the image. As such, it is necessary to identify each reflective surface of the rotating polygon mirror to correct the image data and/or control the optical system for each identified reflective surface.

According to Japanese Patent Laid-Open No. 2004-271691, use of a Hall element to identify reflective surfaces has been proposed. According to Japanese Patent Laid-Open No. 2013-117699, use of a sensor for generating a BD signal to identify reflective surfaces has been proposed. Japanese Patent Laid-Open No. 2012-137598 discloses that a polygon mirror and a sensor for generating the BD signal are provided for each of four photosensitive members.

Japanese Patent Laid-Open No. 2004-271691 and Japanese Patent Laid-Open No. 2013-117699 require one BD sensor and one surface identifying circuit for each polygon mirror. In Japanese Patent Laid-Open No. 2012-137598, four polygon mirrors and four BD sensors are provided, and accordingly four surface identifying circuits are required. Providing the same number of surfaces identifying circuits as the number of rotating polygonal mirrors in this manner leads to an increase in circuit size.

SUMMARY OF THE INVENTION

The present invention provides an information processing apparatus connected to an image forming apparatus comprising an image forming unit. The image forming unit may comprise the following elements. A first photosensitive member is configured to carry a toner image of a first color. A first transfer unit is configured to transfer the toner image of the first color formed on the first photosensitive member to an intermediate transfer member. A first light source is configured to output light on a basis of image data of the first color. A first rotating polygonal mirror including a plurality of reflective surfaces and is configured to scan the first photosensitive member by rotating to deflect the light output from the first light source by the plurality of reflective surfaces. A first light receiving unit is configured to receive the light deflected by the first rotating polygonal mirror. A first output unit is configured to output a first signal in response to reception of the light by the first light receiving unit, the first signal having a first level and a second level. A second photosensitive member is provided downstream of the first photosensitive member in a rotational direction in which the intermediate transfer member rotates, and is configured to carry a toner image of a second color. A second light source is configured to output light on a basis of image data of the second color. A second rotating polygonal mirror including a plurality of reflective surfaces and is configured to scan the second photosensitive member by rotating to deflect the light output from the second light source by the plurality of reflective surfaces. A second light receiving unit is configured to receive the light deflected by the second rotating polygonal mirror. A second output unit is configured to output a second signal in response to reception of the light by the second light receiving unit, the second signal having the first level and the second level. The information processing apparatus may comprises the following elements. An identifying unit is configured to identify a reflective surface used for scanning the first photosensitive member from among the plurality of reflective surfaces of the first rotating polygonal mirror on a basis of the first signal, and to identify a reflective surface used for scanning the second photosensitive member from among the plurality of reflective surfaces of the second rotating polygonal mirror on a basis of the second signal. The identifying unit identifies the reflective surface used for scanning the second photosensitive member after identifying the reflective surface used for scanning the first photosensitive member. A first storage unit is configured to store a plurality of pieces of correction data each of which corresponds to a different one of the plurality of reflective surfaces of the first rotating polygonal mirror. A first correction unit is configured to correct, on a basis of the correction data stored in the first storage unit and information indicating the reflective surface identified by the identifying unit, image data of the first color in association with the reflective surface. A third output unit is configured to output the image data corrected by the first correction unit to the image forming unit. A second storage unit is configured to store a plurality of pieces of correction data each of which corresponds to a different one of the plurality of reflective surfaces of the second rotating polygonal mirror. A second correction unit is configured to correct, on a basis of the correction data stored in the second storage unit and information indicating the reflective surface identified by the identifying unit, image data of the second color in association with the reflective surface. A fourth output unit is configured to output the image data corrected by the second correction unit to the image forming unit.

Further features of the present invention will become apparent from the following description of exemplary embodiments (with reference to the attached drawings).

DESCRIPTION OF THE EMBODIMENTS

Figure 1:
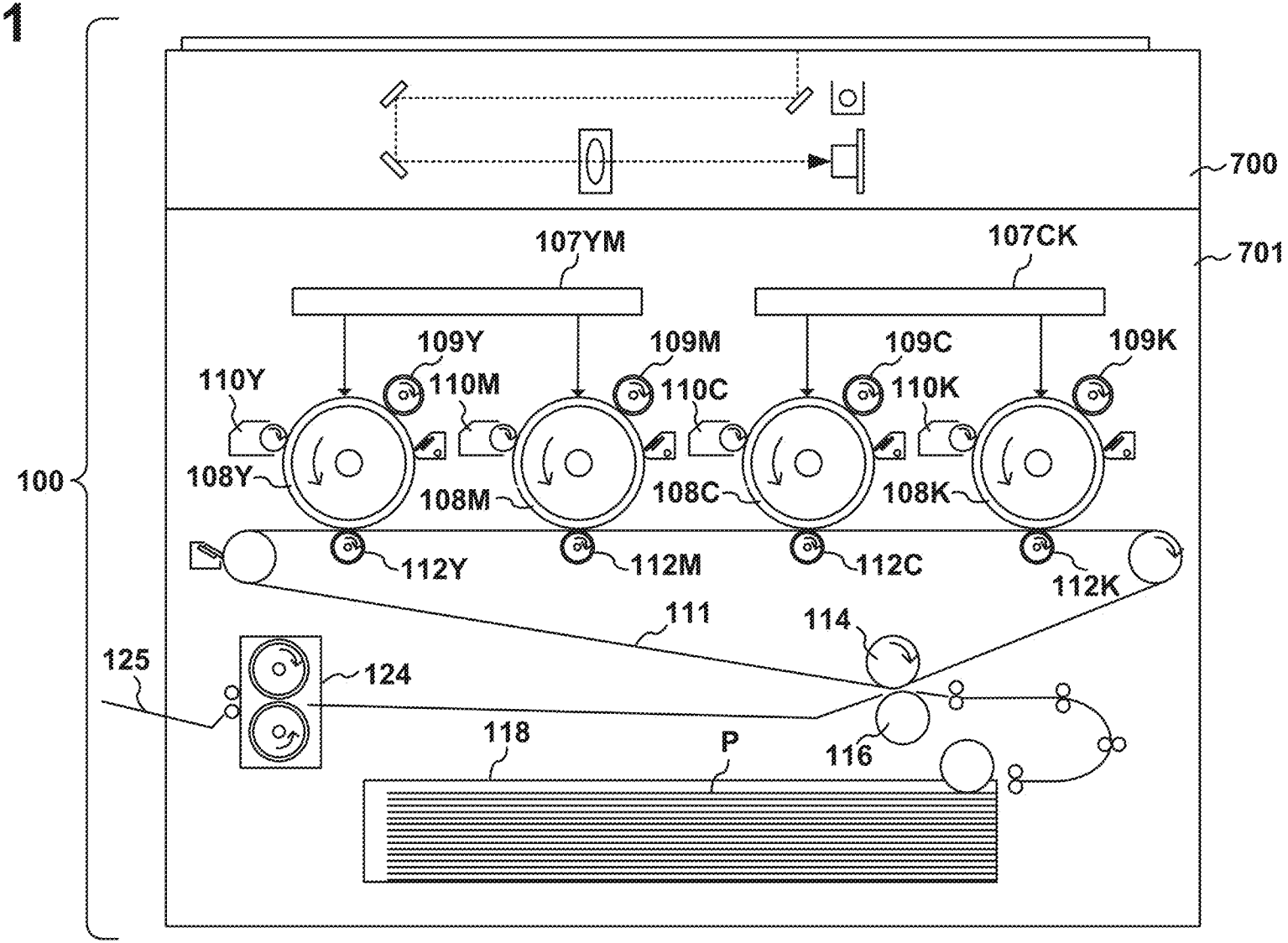
FIG. 1 is a drawing for describing an image forming apparatus.

Embodiments will be described in detail with reference to the accompanying drawings. Note that the following embodiments are not intended to limit the invention according to the claims. Although embodiments describe multiple features, all of these multiple features may not be essential for the invention, and the plurality of features may be appropriately combined. In addition, in the accompanying drawings, the same reference numerals are assigned to the same or similar configurations, and redundant descriptions thereof will be omitted.

Image Forming Apparatus

FIG. 1 is a schematic cross-sectional view of an image forming apparatus 100. With reference to FIG. 1, the image forming apparatus 100 includes a reading unit 700 that reads an original document and an image printing unit 701. The image printing unit 701 includes four image forming stations (image forming units) that superimpose toners of four colors, such as yellow (Y), magenta (M), cyan (C), and black (K), to form a multi-color image. While a letter given at the end of a reference sign indicates the color of the toner, the letters YMCK are omitted when describing a matter common to the four colors. A photosensitive member 108 is an image bearing member having a drum-like shape that bears electrostatic latent images and toner images. A charger 109 of a charging apparatus applies a charging voltage to the photosensitive member 108 to uniformly charge the surface of the photosensitive member 108. The charging voltage is generated by superimposing an alternating current voltage on a direct current voltage. An optical scanning apparatus 107 is an optical scanning apparatus including a laser light source and a rotating polygonal mirror. The optical scanning apparatus 107 modulates and outputs laser light in accordance with image data corresponding to the image read by the reading unit 700, and deflects the laser light with the rotating polygonal mirror. In this manner, the laser light scans the photosensitive member 108, and an electrostatic latent image corresponding to the image data is formed. Thus, the optical scanning apparatus 107 functions as an exposing unit for exposing a uniformly charged photosensitive member to form an electrostatic latent image. A developer 110 houses a toner and forms a toner image on the photosensitive member by attaching the toner to the electrostatic latent image via a developing sleeve. Each of the toner images of the four colors is sequentially transferred to the intermediate transfer belt 111 by a primary transfer unit 112 to form a multi-color image. The intermediate transfer belt 111 transports the toner image to a secondary transfer unit. In the secondary transfer unit, secondary transfer rollers 114 and 116 transports the intermediate transfer belt 111 and a sheet P fed from a cassette 118 in a sandwiching manner. In this manner, the multi-color toner image borne on the intermediate transfer belt 111 is transferred to the sheet P. A fixing apparatus 124 fixes the toner image to the sheet P by applying heat and pressure to the sheet P and the toner image. The sheet on which the toner image has been fixed is ejected to a discharge paper tray 125 provided outside the image forming apparatus 100. The sheet P may be referred to as a recording material, a recording medium, paper, a transfer material, and a transfer paper, for example.

Optical Scanning Apparatus

Figure 2:
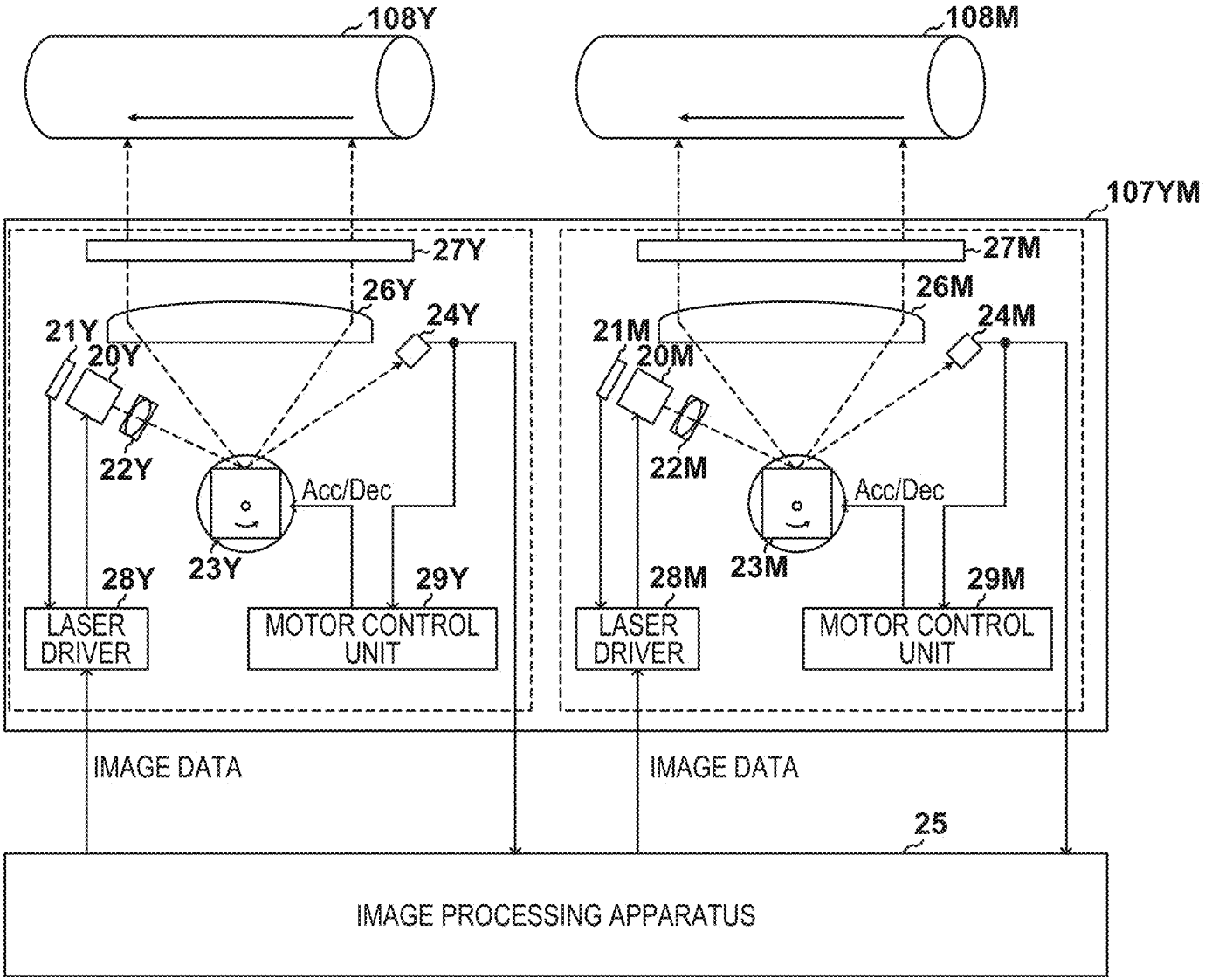
FIG. 2 is a drawing for describing an optical scanning apparatus.

FIG. 2 illustrates an optical scanning apparatus 107YM. The configuration of an optical scanning apparatus 107CK is common with the configuration of the optical scanning apparatus 107YM, and therefore the description of the optical scanning apparatus 107YM may be read as the description of the optical scanning apparatus 107CK. The optical scanning apparatus may be referred to as a laser scanner unit or an exposing apparatus. Note that in the present embodiment, a circuit board on which a laser driver and a motor control unit are provided is a circuit board different from a circuit board on which an image processing apparatus is provided, and the substrates are connected (joined) with each other by a cable. That is, the circuit board on which an identifying unit is provided may be different from the circuit board on which a first output unit and a second output unit are provided. The circuit board on which the identifying unit is provided may be connected, by a cable, with the circuit board on which the first output unit and the second output unit are provided.

A light source 20 is a laser element. Laser light is emitted from both the rear end and the front end of the laser element. The laser light output from the rear end of the light source 20 is incident on a PD 21. PD is an abbreviation of a photodiode. The PD 21 converts laser light into an electric signal to generate a PD signal and inputs the PD signal to a laser driver 28. A PD signal is a signal having a correlation with a reception amount of the laser light. The laser driver 28 controls the output light amount of the light source 20 on the basis of the PD signal. This control is referred to as Auto Power Control (APC). The laser light output from the front end of the light source 20 is incident on a collimator lens 22. The collimator lens 22 is an optical system that converts laser light into parallel light. Laser light is incident on the polygon mirror 23. The polygon mirror 23 includes a rotating polygonal mirror and a motor. The motor drives the rotating polygonal mirror into rotation.

A motor control unit 29 outputs a drive signal to the motor of the polygon mirror 23 to cause the motor to rotate the rotating polygonal mirror. Note that Acc is a drive signal requesting acceleration, and Dec is a drive signal requesting deceleration. In this manner, the polygon mirror 23 rotates counterclockwise. Rotation of the polygon mirror 23 changes the normal direction of the reflective surface of the polygon mirror 23. In other words, the incident angle and the emission angle of the laser light with respect to the reflective surface change at all times. In this manner, scanning of the photosensitive member with the laser light is achieved.

The laser light first is incident on a BD sensor 24. The BD sensor 24 generates and outputs a detection signal BD when the laser light is incident thereon. The detection signal BD falls in response to incidence of the laser light, and the detection signal BD rises in response to a stop of incidence of the laser light. The relationship between the rising and falling may be reversed. The detection signal BD is input to the motor control unit 29. The motor control unit 29 performs a feedback control such that the rotation period of the polygon mirrors 23 is set to a target period on the basis of the detection signal BD. Further, the detection signal BD is also input to an image processing apparatus 25. The image processing apparatus 25 outputs a laser drive signal to the laser driver 28 in accordance with the detection signal BD. The image processing apparatus 25 generates a laser drive signal on the basis of the image data acquired by the reading unit 700. The image processing apparatus 25 may be referred to as an information processing apparatus. The laser driver 28 causes the light source 20 to flash on the basis of the laser drive signal. The surface of the photosensitive member 108 is selectively exposed with laser light to form an electrostatic latent image. Note that the laser light scans the photosensitive member 108 at a constant speed by passing through an Fθ lens 206 and a turning mirror 207.

Configuration of Surface Identifying Unit

Figure 3:
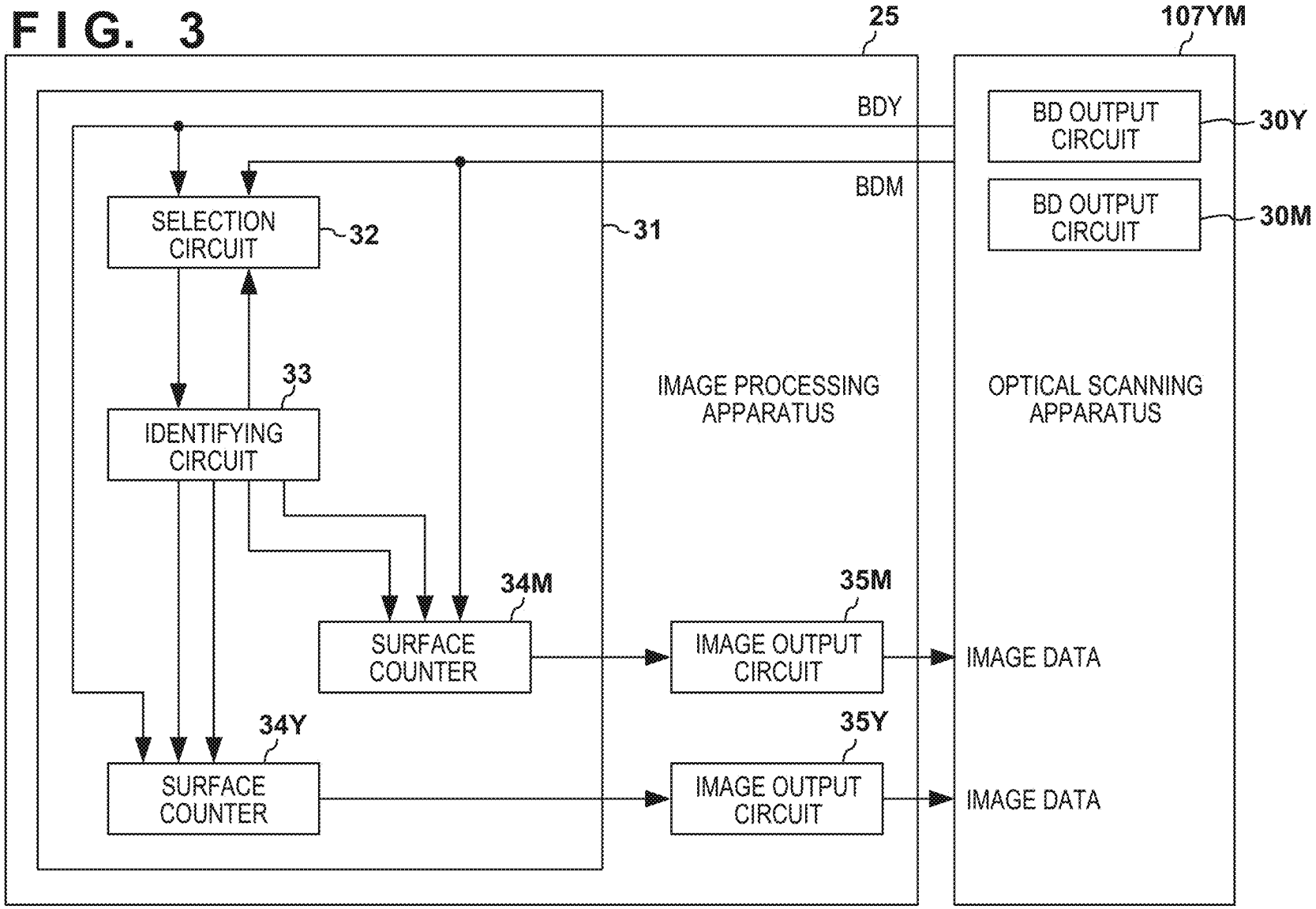
FIG. 3 is a drawing for describing a surface identifying unit.

In FIG. 3, the image processing apparatus 25 is connected to the optical scanning apparatuses 107YM and 107CK. Description of the optical scanning apparatus 107CK is omitted here. A BD output circuit 30Y outputs a detection signal BDY signal in response to light reception at a BD sensor 24Y. A BD output circuit 30M outputs a detection signal BDM in response to light reception at a BD sensor 24M. The image processing apparatus 25 receives the detection signals BDY and BDM from the optical scanning apparatus 107YM, and utilizes the detection signals BDY and BDM as horizontal synchronization signals. The image processing apparatus 25 includes a surface identifying unit 31 and an image output circuit 35.

The detection signals BDY and BDM are input to a selection circuit 32 provided in the surface identifying unit 31. The selection circuit 32 selects any of the detection signals BDY and BDM on the basis of the selection signal output from the identifying circuit 33, and outputs the selected signal to the identifying circuit 33. Note that, of the detection signals BDY and BDM, the signal selected by the selection circuit 32 is denoted as a detection signal BD for the sake of simplicity of the description. The identifying circuit 33 is provided to be shared for the two detection signals BDY and BDM. The identifying circuit 33 measures the time interval between adjacent pulses of the detection signal BD selected by the selection circuit 32, and identifies a reflective surface that reflects the laser light on the basis of the measured time interval. The lengths of the reflective surfaces forming the polygon mirror 23 (the lengths in the rotational direction of the polygon mirror 23) are different from each other. Accordingly, the measured time intervals of the respective reflective surfaces are different from each other. Since the length of each reflective surface is known, the time interval of the pulses corresponding to each reflective surface is also known. Thus, the identifying circuit 33 identifies the reflective surface by comparing the measured value and the known time interval. When the reflective surface is identified for a photosensitive member 108Y, the identifying circuit 33 sets the identified result (surface number) to a surface counter 34Y. When the reflective surface is identified for a photosensitive member 108M, the identifying circuit 33 sets the identified result (surface number) to a surface counter 34M. Note that the circuit size of the identifying circuit 33 tends to be relatively large. In the present embodiment, a single identifying circuit 33 to be shared is provided for the plurality of photosensitive members 108 (the plurality of BD sensors 24). Thus, the circuit size in the image processing apparatus 25 can be reduced.

The surface counter 34 is a counter that sets the surface number set by the identifying circuit 33 as an initial value and performs count-up each time the detection signal BD is input. Note that the count value returns to a minimum value after a maximum value. Note that the maximum value corresponds to the number of reflective surfaces of the polygon mirror, and is set to 4 in the present embodiment. The surface counter 34 outputs a count value (surface number) to the image output circuit 35. The image output circuit 35 corrects the image data (e.g., correction of the timing of writing the image) on the basis of correction data corresponding to the surface number.

Figure 10:
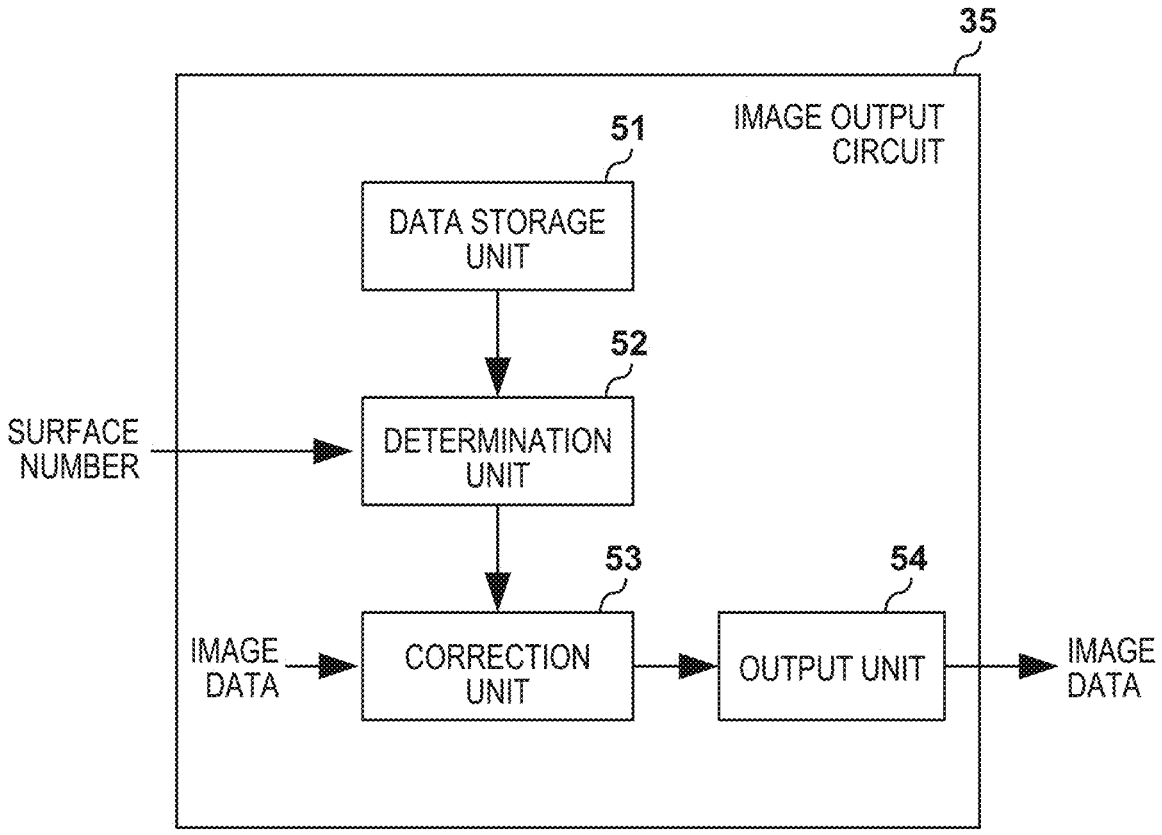
FIG. 10 is a drawing for describing an image output circuit.

In FIG. 10, a data storage unit 51 stores correction data for each surface number. A determination unit 52 determines the correction data on the basis of the surface number output from the surface counter 34. For example, the determination unit 52 reads correction data corresponding to the surface number from the data storage unit 51, and outputs the correction data to the correction unit 53. The correction unit 53 corrects the image data on the basis of the correction data, and outputs the corrected image data to the output unit 54. The output unit 54 outputs the image data input from the correction unit 53 to the optical scanning apparatus 107.

Figure 4:
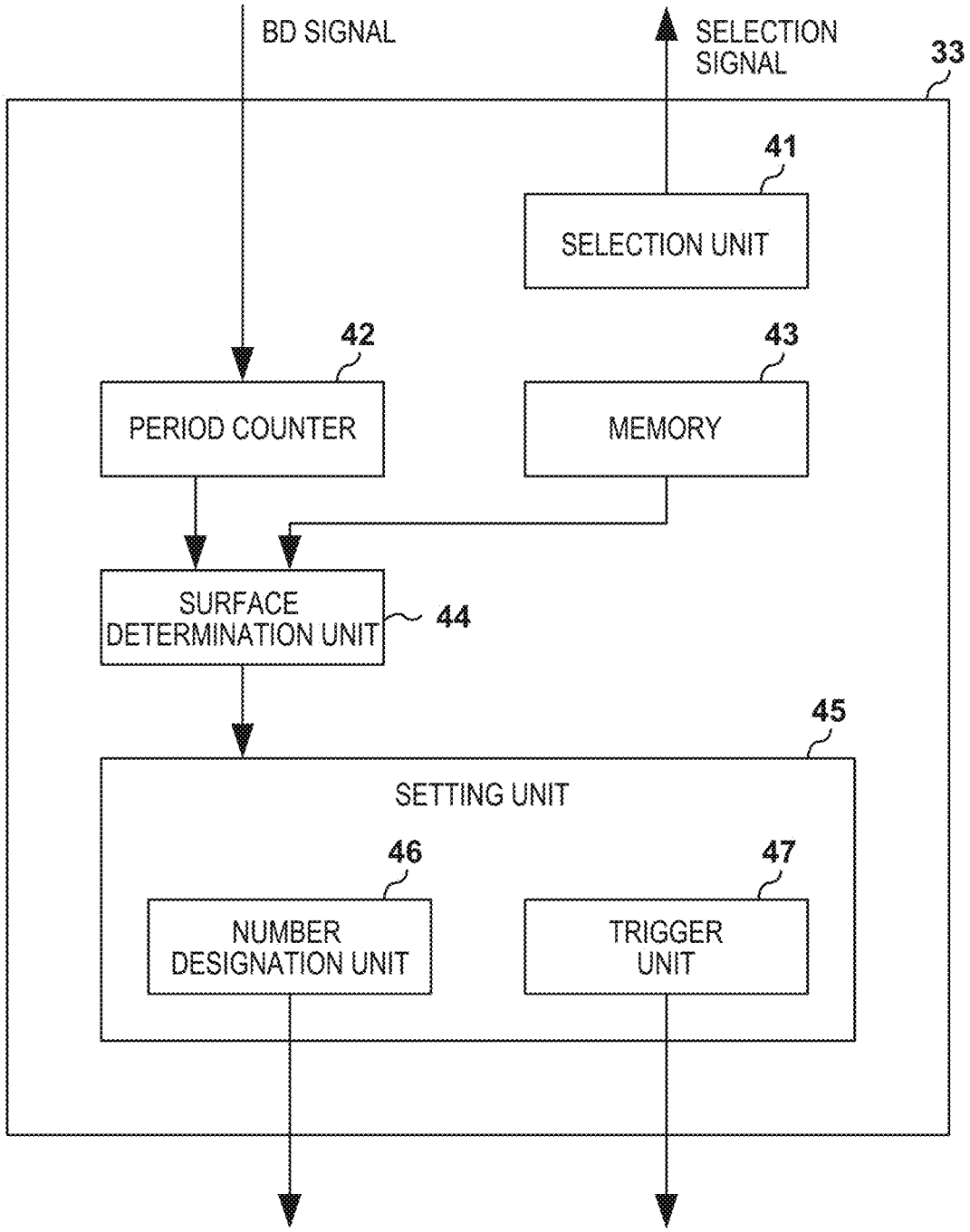
FIG. 4 is a drawing for describing an identifying circuit.

In FIG. 4, the selection unit 41 generates a selection signal for selecting any of the detection signals BDY and BDM, and outputs the generated signal to the selection circuit 32. As already illustrated in FIG. 1, the photosensitive member 108Y is disposed upstream of the photosensitive member 108M in the transport direction (rotational direction) of the intermediate transfer belt 111. In other words, the photosensitive member 108Y must start creating an image before the photosensitive member 108M. Accordingly, the selection unit 41 outputs a selection signal for selecting the detection signal BDY to the selection circuit 32. When the surface identification of a polygon mirror 23Y is completed, the selection unit 41 outputs a selection signal for selecting the detection signal BDM to the selection circuit 32.

A period counter 42 measures the time (BD period) from the falling edge of a preceding detection signal BD to the falling edge of a succeeding detection signal BD, and outputs the measurement result to the surface determination unit 44. Period information is stored in a non-volatile storage region in a memory 43. The period information retains information indicating the BD period of each reflective surface of the polygon mirror 23 and the surface number of each reflective surface in association with each other. When the falling edge of the succeeding detection signal BD is input, the surface determination unit 44 latches the count value of the period counter 42, identifies the surface number associated with the BD period closest to the count value, and outputs the surface number to a setting unit 45.

Figure 5A:
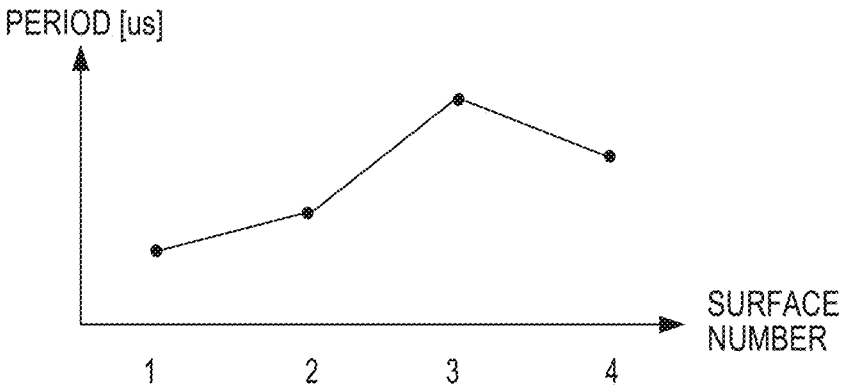
FIGS. 5A to 5E are drawings for describing a relationship between a surface number and a BD period.

FIG. 5A illustrates ideal values (reference values) of BD periods of the reflective surfaces of the polygon mirror 23Y. The ideal values are measured values measured when the optical scanning apparatus 107 is assembled in a factory. Here, the polygon mirror 23Y includes four reflective surfaces. The horizontal axis indicates the surface number. The vertical axis indicates the ideal value of the BD period. As illustrated in FIG. 5A, the ideal values of the BD periods of the respective reflective surfaces are different from each other. The memory 43 stores the surface numbers in association with the ideal values of the BD periods of the reflective surface.

Figure 5B:
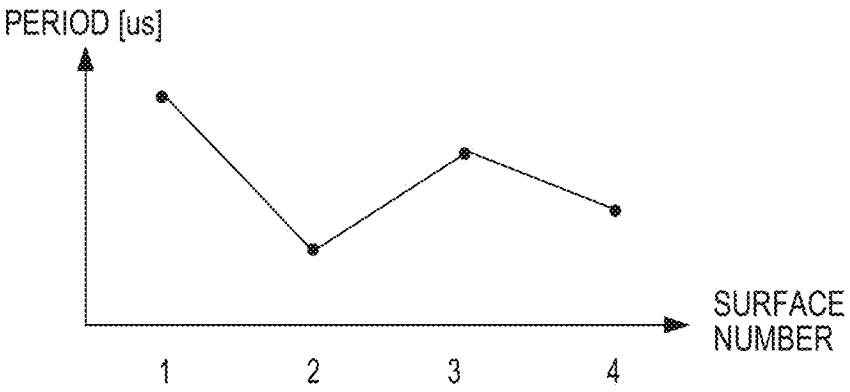

FIG. 5B illustrates an ideal value for BD periods of each reflective surface for a polygon mirror 23M. Here, the polygon mirror 23M includes four reflective surfaces. The horizontal axis indicates the surface number. The vertical axis indicates the ideal value of the BD period. As illustrated in FIG. 5B, the ideal values of the BD periods of the respective reflective surfaces are different from each other. The memory 43 stores the surface numbers in association with the ideal values of the BD periods of the reflective surface.

Figure 5C:
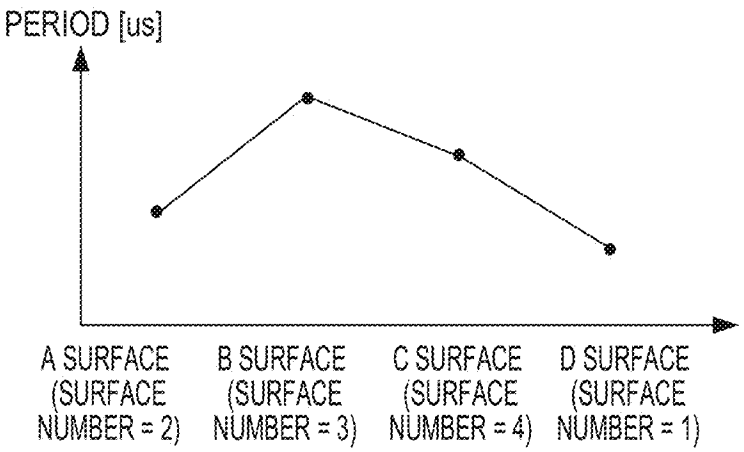
Figure 5D:
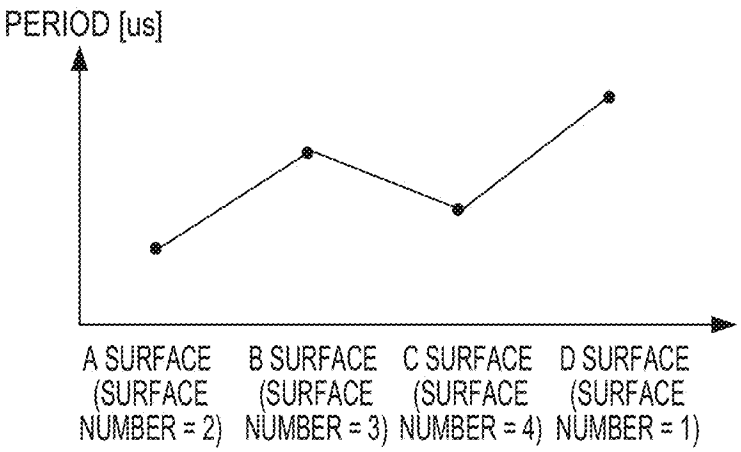

FIG. 5C illustrates measured values of the BD periods of the polygon mirror 23Y. Comparing FIG. 5C with FIG. 5A, it can be said that the measured values are substantially close to the ideal values. FIG. 5D illustrates measured values of the BD periods of the polygon mirror 23M. Comparing FIG. 5B with FIG. 5A, it can be said that the measured values are substantially close to the ideal values.

Figure 5E:
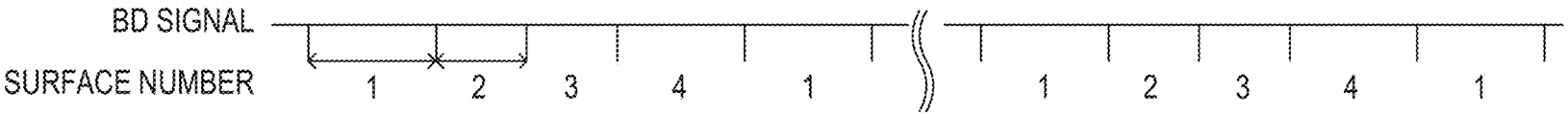

The period counter 42 measures the period of the detection signal BD output from the optical scanning apparatus 107 during at least one turn of the polygon mirror 23. The surface determination unit 44 identifies the surface number by comparing the measured value with the ideal value of the BD period. FIG. 5E illustrates an example of a measurement result. As illustrated in FIG. 5E, the surface number is identified by counting the BD periods with the period counter 42.

It suffices that the surface determination unit 44 identifies the surface number of at least one reflective surface. The reason for this is that the surface numbers are cyclic as illustrated in FIG. 5E. However, the surface determination unit 44 may identify two or more surface numbers. For example, in the case where the BD periods of two reflective surfaces of the four reflective surfaces are substantially equal to each other, the surface determination unit 44 cannot identify the correct surface number with only the measurement result of one reflective surface. In this case, the surface determination unit 44 identifies two surface numbers of at least two adjacent reflective surfaces on the basis of the reflection results. When two surface numbers are identified in this manner, the remaining two surface numbers can be identified in accordance with the cycle of the surface numbers.

Note that it is possible to acquire a plurality of measured values for each reflective surface by rotating the polygon mirror 23 a plurality of times. In this case, the surface determination unit 44 may identify the surface number with use of a statistical value (e.g., an average value) of the plurality of measured values.

The memory 43 stores period information for the polygon mirror 23Y and period information for the polygon mirror 23M. The surface determination unit 44 selects, from the period information for the polygon mirror 23Y and the period information for the polygon mirror 23M, the period information corresponding to a selection signal of the selection unit 41, and uses the selected period information.

The period counter 42 operates using a reference clock. The reference clock may be an operation clock of the image output circuit 35, an operation clock of the laser drive signal supplied by the image output circuit 35 or the like. The higher the reference clock, the higher the accuracy of the measured value.

As illustrated in FIG. 4, the setting unit 45 may include a number designation unit 46 and a trigger unit 47. The number designation unit 46 designates the surface number identified by the surface determination unit 44 for the surface counter 34 selected in accordance with the selection signal. For example, when a selection signal for selecting the detection signal BDY is output, the surface counter 34Y is selected. The trigger unit 47 outputs a trigger signal when the surface number designated by the surface counter 34 is updated. When receiving the trigger signal, the surface counter 34 sets the surface number designated by the surface counter 34 to the initial value of the count value. Thereafter, the surface counter 34 increments the count value on the basis of the falling of the detection signal BD.

The magenta photosensitive member 108M superimposes a magenta toner image on the yellow toner image transferred to the intermediate transfer belt 111 by the yellow photosensitive member 108Y. To precisely align the yellow toner image and the magenta toner image, a time difference Td must be properly maintained. The time difference Td is a time difference between the start timing of exposure of the photosensitive member 108Y to the laser light and the start timing of exposure of the photosensitive member 108M to the laser light. The time difference Td is a time acquired by dividing a distance L between the primary transfer position (nip portion) of the photosensitive member 108Y and the primary transfer position (nip portion) of the photosensitive member 108M by a transport speed V of the intermediate transfer belt 111. Thus, the surface number for magenta needs to be identified within a period corresponding to this time difference Td. Further, a certain amount of processing time is also required for correction of the image data. As such, the sum of the time Ts required for the identification of the surface number and the time Tu required for the correction processing of the image data must be less than or equal to the time difference Td.

$$Ts+Tu+Tm=<Td \quad (1)$$

Here, Tm is a margin, and is determined by an experiment and/or a simulation. By adding a margin, the surface number for the magenta can be more reliably identified within the period corresponding to the time difference Td. Note that the distance L is determined to satisfy the Equation (1). In other words, the distance L can be shortened when the time required for the identifying process of the surface number and/or the image processing can be shortened. Note that the time required for the image processing is proportional to the number of main scanning lines in a case where the optical scanning apparatus 107 can perform the formation by a single scanning, for example. For example, in a case where the optical scanning apparatus 107 can scan the four main scanning lines by a single scanning, the image output circuit 35 must be able to correct image data corresponding to the four main scanning lines. In this case, the time taken for the image processing is at least the time required for correcting the image data corresponding to the four main scanning lines.

Flowchart of Surface Identification Process

Figure 6:
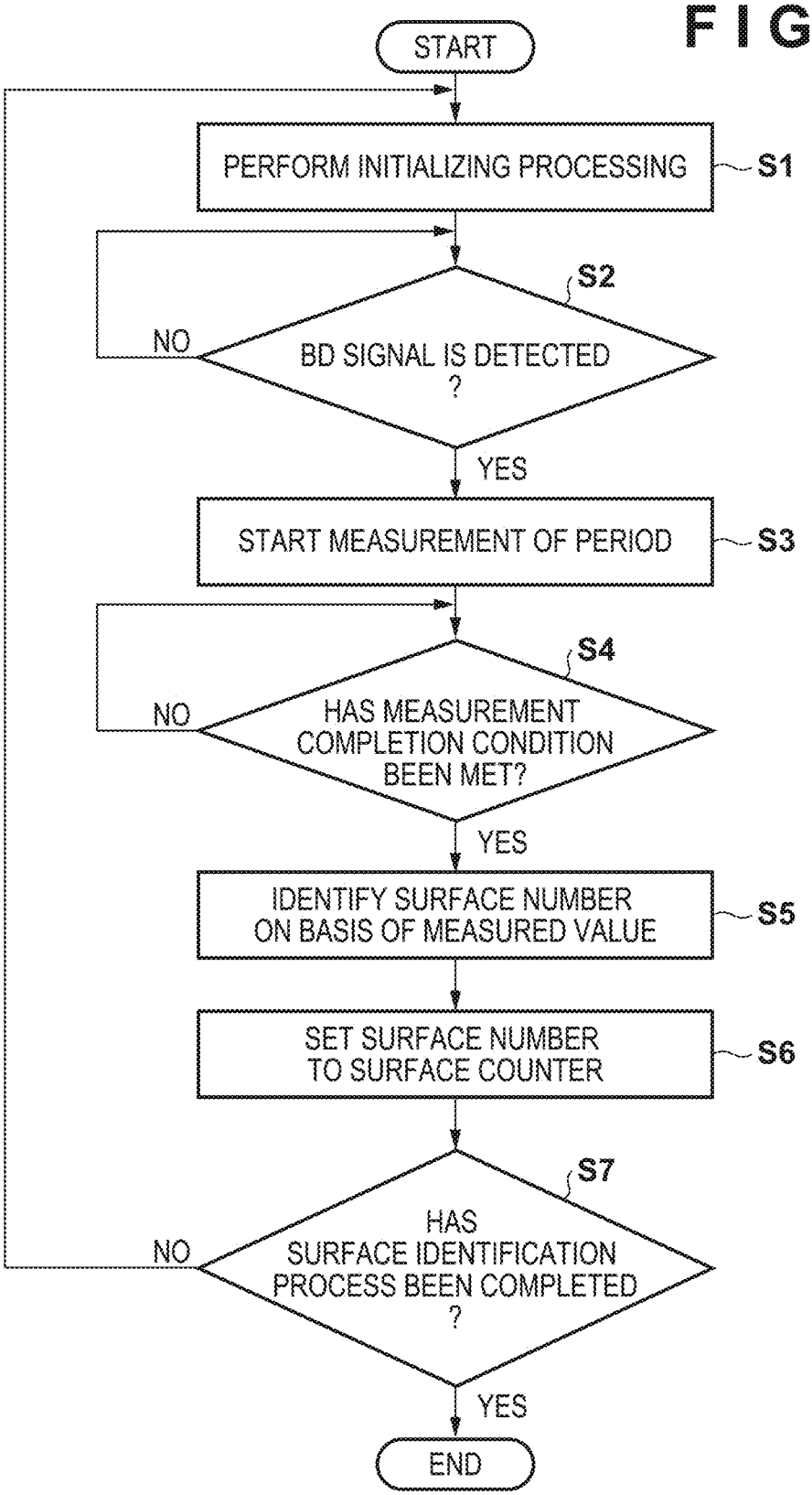
FIG. 6 is a flow chart illustrating a surface identification process.

FIG. 6 is a flowchart illustrating a surface identification process executed by the image processing apparatus 25. When a print job is input, the image processing apparatus 25 executes the surface identification process.

At S1, the surface identifying unit 31 of the image processing apparatus 25 initializes both the surface counter 34 and the period counter 42. The selection unit 41 selects one of the plurality of detection signals BDY and BDM, and outputs the selected signal to the selection circuit 32. As described above, the selection unit 41 selects the detection signal BDY first, and then selects the detection signal BDM.

At S2, the identifying circuit 33 of the image processing apparatus 25 determines whether the detection signal BD has been detected. More specifically, the identifying circuit 33 monitors the falling edge of the detection signal BD. When the falling edge of the detection signal BD is detected, the image processing apparatus 25 advances the process to S3.

At S3, the identifying circuit 33 of the image processing apparatus 25 starts measurement of the period of the detection signal BD with use of the period counter 42. For example, the identifying circuit 33 outputs an enable signal to the period counter 42 to cause the period counter 42 to start the measurement of the period.

At S4, the identifying circuit 33 of the image processing apparatus 25 determines whether a measurement completion condition has been met. The measurement completion condition is a condition for completing the measurement of the period by the period counter 42. The measurement completion condition may be, for example, detection of the falling edge of the detection signal BD for N times. In the case where the period is measured n times for one reflective surface in the above-mentioned manner, N=n×m. m is the number of the surfaces of the polygon mirror 23. n is 32, for example. When the measurement completion condition has been met, the identifying circuit 33 terminates the measurement of the period of the detection signal BD using the period counter 42, and advances the process to S5.

At S5, the identifying circuit 33 of the image processing apparatus 25 identifies the surface number on the basis of the measured value of the BD period. The above-described surface determination unit 44 of the identifying circuit 33 identifies the surface number of each reflective surface by comparing the degrees of the sameness between the measured value of the BD period and the ideal value (reference value) of the BD period retained in the memory 43. As illustrated in FIG. 5C, the surface numbers of the surfaces A to D of the polygon mirror 23Y are identified as 2, 3, 4 and 1, respectively. Here, it is assumed that the surface numbers are identified in the order of the surface A, the surface B, the surface C, and the surface D.

At S6, the identifying circuit 33 of the image processing apparatus 25 sets the surface number identified by the surface determination unit 44 to the surface counter 34. The number designation unit 46 sets, to the surface counter 34, the surface number of the reflective surface that reflects the laser light at the timing of designation of the surface number to the surface counter 34. The trigger unit 47 outputs a trigger signal to the surface counter 34 to cause the surface counter 34 to update the surface number. Thus, the surface counter 34 executes count-up each time the detection signal BD is input, with the surface number designated by the number designation unit 46 as an initial value.

At S7, the identifying circuit 33 of the image processing apparatus 25 determines whether the surface identification process has been completed. In this example, the surface identification process is performed for the two detection signals BDY and BDM. Accordingly, the identifying circuit 33 may determine whether both the surface number for the detection signal BDY, and the surface number for the detection signal BDM have been identified. When a detection signal BD (polygon mirror) whose surface number has not been identified is present, the image processing apparatus 25 returns the process to S1, and executes the surface identification process on the next detection signal BD (polygon mirror). When a detection signal BD (polygon mirror) whose surface number has not been identified is not present, the image processing apparatus 25 terminates the surface identification process.

Here, the identifying process is performed only once when the print job is input. However, the surface identification process may be repeatedly executed while the image forming apparatus 100 executes the print job. This might reduce a mismatch of the surface number and the reflective surface due to external vibration and noise.

By employing the above-described surface identification process, the image processing apparatus 25 can determine the reflective surface (scanning surface) of the polygon mirror 23 on which laser light is incident at all times. The image processing apparatus 25 can correct the magnification and the writing position of the image in accordance with the scanning surface of the polygon mirror 23. The image output circuit 35 may include a non-volatile memory that stores the correction data associated with the surface numbers. The image output circuit 35 reads the correction data corresponding to the surface number from the memory, and executes a correction in accordance with the correction data. Thus, image distortion due to the mounting accuracy and the cutting accuracy of the scanning surfaces of the polygon mirrors 23 and the like is reduced.

Timing Chart of Surface Identification

Figure 7:
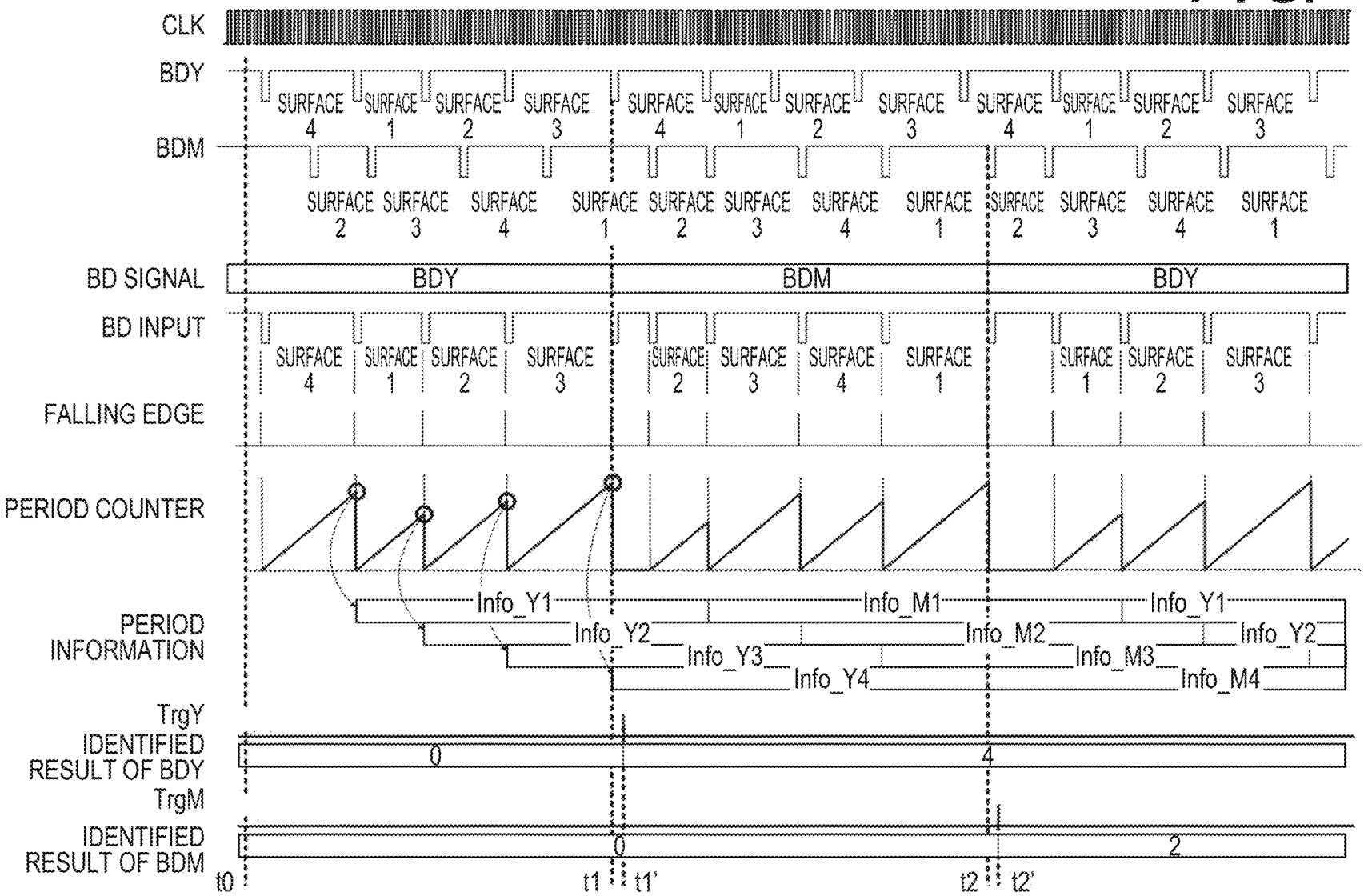
FIG. 7 is a timing chart of the surface identification process.

FIG. 7 is a timing chart illustrating an operation of the identifying circuit 33. As illustrated in FIG. 7, a print job is started at a time t0, and supply of detection signals BDY and BDM is started. In this timing chart, a detection signal BD is supplied substantially simultaneously with the start of the print job. However, the detection signal BD may be supplied before the start of the print job, or supply of the detection signal BD may be started when a certain amount of time has elapsed after the start of the print job.

When the print job is started, the identifying circuit 33 initializes the BD number. For example, the BD number of the detection signal BDY may be 1, and the BD number of the detection signal BDM may be 2. The identifying circuit 33 may distinguish between the detection signal BDY and the detection signal BDM on the basis of the BD numbers. By initializing the BD number, the identifying circuit 33 is brought into a state in which the detection signal BD for the photosensitive member 108 that will first transfer the toner image to the intermediate transfer belt 111 is input to the identifying circuit 33. The period counter 42 is also initialized to be able to start the counting. In the present embodiment, the detection signal BDY is input to the identifying circuit 33 before the detection signal BDM. The initial value of the period counter 42 is 0. Thereafter, when the detection signal BD is input, the period counter 42 starts the counting. The period counter 42 increments the count value in synchronization with a clock signal CLK. When the next detection signal BD is input, the identifying circuit 33 outputs the count value of the period counter 42 to the surface determination unit 44 as a measurement result. Further, the identifying circuit 33 clears the period counter 42, and the period counter 42 starts a measurement of the next BD period.

Time t1 is a timing at which the measurement of the BD period of all reflective surfaces of the polygon mirror 23 has been completed. The time t1 is a timing at which the measurement completion condition has been met at S4. The identifying circuit 33 executes S5 at the time t1. That is, the identifying circuit 33 determines the surface number on the basis of comparison between the measured value of the period counter 42 and the ideal value of period information Info_Yi retained in the memory 43. i is an index that takes on values from 1 to 4. In this example, the period counter 42 stops the counting in the period from the time t1 until an input of the next detection signal BD. The reason for this is to reduce unnecessary operation. However, the period counter 42 may continue the counting. In this case, the identifying circuit 33 does not output, to the surface determination unit 44, the count value at the time when the next detection signal BD is input, and the period counter 42 starts the next count. In addition, the identifying circuit 33 switches the identification information on the detection signal BD from BDY to BDM. As a result, the surface identification process for the next detection signal BDM is started.

At a time t1', S6 is executed. In other words, the surface number is set to the surface counter 34Y corresponding to the detection signal BDY. The surface number is output to the surface counter 34Y together with a trigger signal TrgY. The time difference between the time t1 and the time t1' depends on the time required for the surface determination process. The shorter the time required for the surface determination process, the more the time difference can be reduced. When the time t1' has elapsed, the identifying circuit 33 starts the surface identification process for the detection signal BDM.

A time t2 is a timing at which the measurement of the BD period for four reflective surfaces has been completed for the polygon mirror 23M. The identifying circuit 33 executes S5. That is, the identifying circuit 33 determines the surface number on the basis of comparison between the measured value of the period counter 42 and the ideal value of period information Info_Mi retained in the memory 43. The identifying circuit 33 switches the identification information on the detection signal BD from BDM to BDY (changes the BD number from 2 to 1). As a result, the surface identification process for the next detection signal BDY is started. Note that the surface identification process for the detection signal BDY may not be executed.

At a time t2', S6 is executed. In other words, the surface number is set to the surface counter 34M corresponding to the detection signal BDM. The surface number is output to the surface counter 34M together with a trigger signal TrgM.

Figure 8:
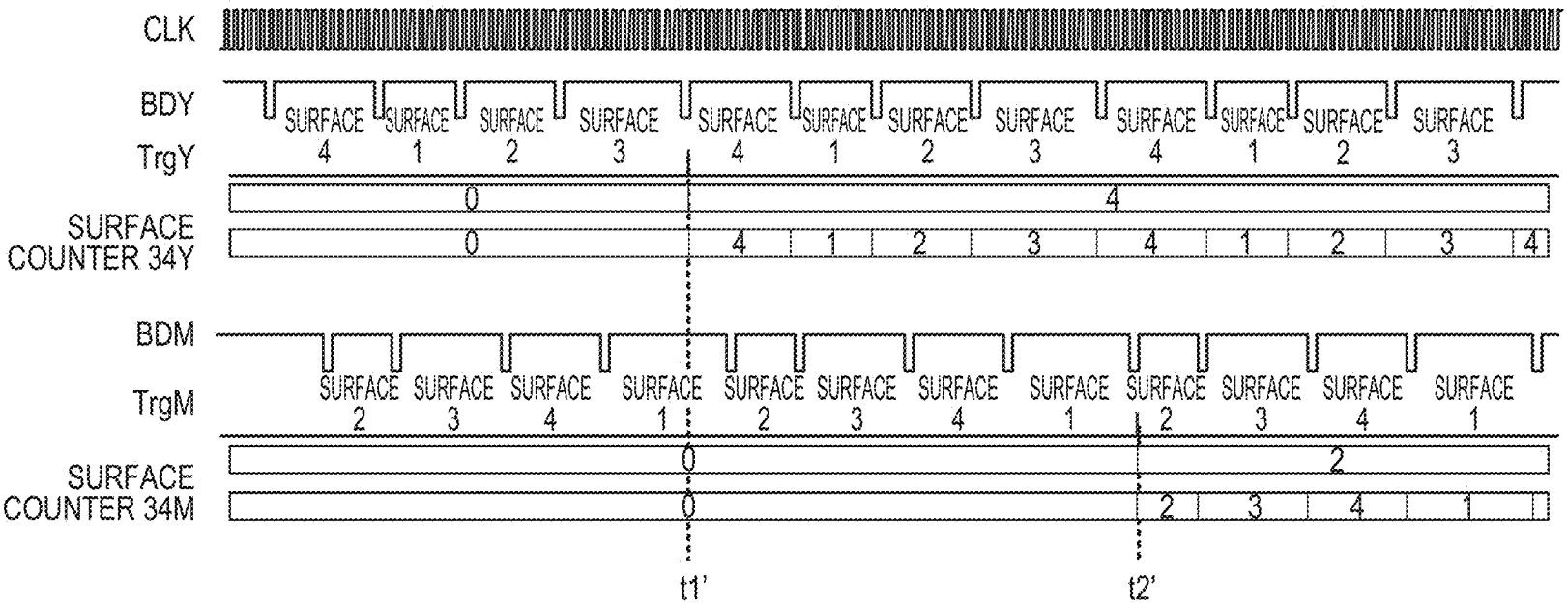
FIG. 8 is a timing chart of the surface identification process.

FIG. 8 is a timing chart illustrating an operation of the surface counter 34. Until the time t1', the count value of surface counter 34 is maintained at an initial value "0". However, the surface counter 34 may continue the counting. Also in this case, when the surface number is set, the surface counter 34 executes the counting on the basis of the surface number.

At the time t1', the surface counter 34Y receives the surface number and the trigger signal TrgY from the identifying circuit 33. Note that the time t1' illustrated in FIG. 8 and the time t1' illustrated in FIG. 7 are the same timing. When detecting the trigger signal TrgY, the surface counter 34Y corrects its own count value to a count value corresponding to the surface number designated by the identifying circuit 33. In the present example, "4" is designated as the surface number at the time t1', and accordingly the surface counter 34Y has corrected its own count value to "4". Thereafter, the surface counter 34Y increments its own count value by the input detection signal BDY. In addition, when the count value reaches the maximum surface number, the surface counter 34Y returns the count value to the minimum surface number.

At the time t2', the surface counter 34M receives the surface number and the trigger signal TrgM from the identifying circuit 33. Note that the time t2' illustrated in FIG. 8 and the time t2' illustrated in FIG. 7 are the same timing. When detecting the trigger signal TrgM, the surface counter 34M corrects its own count value to a count value corresponding to the surface number designated by the identifying circuit 33. In the present example, "2" is designated as the surface number at the time t2', and accordingly the surface counter 34M has corrected its own count value to "2". Thereafter, the surface counter 34M increments its own count value by the input detection signal BDM. In addition, when the count value reaches the maximum surface number, the surface counter 34M returns the count value to the minimum surface number.

Overview

The polygon mirror 23Y is an example of a rotatable first rotating polygonal mirror including a plurality of reflective surfaces that reflect light output from a light source 20Y. The light source 20Y is an example of a first light source configured to output light on a basis of image data of the first color. The polygon mirror 23Y is an example of the first rotating polygonal mirror configured such that light reflected by the first rotating polygonal mirror scans a first photosensitive member with rotation of the first rotating polygonal mirror. The photosensitive member 108Y for a first color is an example of the first photosensitive member to carry a toner image of the first color. The BD sensor 24Y is an example of a first detecting unit that is scanned by light reflected by the first rotating polygonal mirror with rotation of the first rotating polygonal mirror, and outputs a first signal when the light is incident on the unit. The BD sensor 24Y is an example of a first light receiving unit that receives light deflected by the first rotating polygonal mirror. The BD output circuit 30Y is an example of a first output unit that outputs a first signal in response to light reception at the first light receiving unit. The first signal has a first level and a second level. The polygon mirror 23M is an example of a rotatable second rotating polygonal mirror including a plurality of reflective surfaces that reflect light output from a light source 20M. The light source 20M is an example of a second light source configured to output light on a basis of image data of the second color. The polygon mirror 23M is an example of the second rotating polygonal mirror configured such that light reflected by the second rotating polygonal mirror scans a second photosensitive member with rotation of the second rotating polygonal mirror. The photosensitive member 108M is an example of the second photosensitive member provided downstream of the first photosensitive member in a rotational direction in which the intermediate transfer member rotates, and configured to carry a toner image of a second color. The BD sensor 24M is an example of a second detecting unit that is scanned by light reflected by the second rotating polygonal mirror with rotation of the second rotating polygonal mirror, and outputs a second signal when the light is incident on the unit. The second signal has the first level and the second level. The BD sensor 24M is an example of a second light receiving unit that receives light deflected by the second rotating polygonal mirror. The BD output circuit 30M is an example of a second output unit that outputs a second signal in response to light reception at the second light receiving unit. The surface identifying unit 31 and the identifying circuit 33 are an example of an identifying unit provided to be shared for the first signal and the second signal. The identifying unit identifies, from among the plurality of reflective surfaces of the first rotating polygonal mirror, the reflective surface reflecting light from the light source on the basis of the first signal. Further, the identifying unit identifies, from among the plurality of reflective surfaces of the second rotating polygonal mirror, the reflective surface reflecting light from the light source on the basis of the second signal. As described above, according to the present embodiment, a single identifying unit is provided to be shared by a plurality of rotating polygonal mirrors. Thus, the number of identifying units for identifying the reflective surface is reduced relative to the number of rotating polygonal mirrors. In addition, sharing the identifying units reduces the circuit size of the circuits that engage in the specification of the reflective surface. That is, the reflective surface can be identified while suppressing increase in circuit size.

The surface identifying unit 31 and the identifying circuit 33 are examples of an identifying unit that identifies both a reflective surface used for scanning the first photosensitive member among the plurality of reflective surfaces of the first rotating polygonal mirror and a reflective surface used for scanning the second photosensitive member among the plurality of reflective surfaces of the second rotating polygonal mirror. The surface identifying unit 31 and the identifying circuit 33 identify the reflective surface used for scanning the second photosensitive member on the basis of the second signal after identifying the reflective surface used for scanning the first photosensitive member on the basis of the first signal. The data storage unit 51 for Y is an example of a first storage unit that stores a plurality of pieces of correction data each of which corresponds to a different one of the plurality of reflective surfaces of the first rotating polygonal mirror. The determination unit 52 and the correction unit 53 are examples of a first correction unit that corrects image data of the first color in association with the reflective surface on the basis of the correction data stored in the first storage unit and the information indicating the reflective surface identified by the identifying unit. The output unit 54 for Y is an example of a third output unit that outputs image data corrected by the first correction unit to the image forming unit. The data storage unit 51 for M is an example of a second storage unit that stores a plurality of pieces of correction data each of which corresponds to a different one of the plurality of reflective surfaces of the second rotating polygonal mirror. The determination unit 52 and the correction unit 53 for M are examples of a second correction unit that corrects image data of the second color in association with the reflective surface on the basis of the correction data stored in the second storage unit and the information indicating the reflective surface identified by the identifying unit. The output unit 54 for M is an example of a fourth output unit that outputs image data corrected by the second correction unit to the image forming unit.

The identifying unit identifies, from among the plurality of reflective surfaces of the first rotating polygonal mirror, the reflective surface reflecting light from the light source on the basis of the first signal. Thereafter, the identifying unit identifies, from among the plurality of reflective surfaces of the second rotating polygonal mirror, the reflective surface reflecting light from the light source on the basis of the second signal. In this manner, the identifying unit may share a single identifying unit by executing the identifying process for the first signal and the identifying process for the second signal in different periods.

Of the first signal and the second signal, the identifying unit may select the first signal to identify, from among the plurality of reflective surfaces of the first rotating polygonal mirror, the reflective surface reflecting light from the light source on the basis of the first signal. Of the first signal and the second signal, the identifying unit may select the second signal to identify, from among the plurality of reflective surfaces of the first rotating polygonal mirror, the reflective surface reflecting light from the light source on the basis of the first signal. In this manner, the identifying unit may select one detection signal from among the plurality of detection signals to identify the reflective surface for each of the plurality of detection signals. The selection circuit 32 is an example of a selection unit configured to select one detection signal of the first signal and the second signal in accordance with the selection signal.

The memory 43 is an example of a storage unit storing information relating to the length of each of the plurality of reflective surfaces in the rotational direction of the first rotating polygonal mirror, the information being preliminarily acquired for each of the plurality of reflective surfaces of the first rotating polygonal mirror. The length of the reflective surface is correlated with a BD period that is acquired by the BD sensor 24 when the polygon mirror 23 is rotating at a predetermined target rotational speed, for example. The period counter 42 is an example of a measuring unit that measures a time from a falling edge to a next falling edge of the first signal selected by the selection unit. The surface determination unit 44 may identify the reflective surface reflecting light from the light source in the first rotating polygonal mirror on the basis of the time measured by the measuring unit and the information relating to the length of each of the reflective surfaces of the first rotating polygonal mirror stored in the storage unit. Note that the lengths of the reflective surfaces of the first rotating polygonal mirror are different from each other. The length of each reflective surface has been set at factory shipment, and the length of each reflective surface does not change even when the user forms an image. Thus, information relating to the length of the reflective surface may be acquired at factory shipment or the like and stored in the ROM of the memory 43 or the like so as to identify the reflection surface by comparing information acquired by the period counter 42 with the information relating to the length of the reflective surface. The memory 43 is an example of a third storage unit configured to store information relating to a time interval between a first timing when the first signal changes from the first level to the second level and a second timing when the first signal changes from the first level to the second level, the second timing being a next timing of the first timing, and the information being preliminarily acquired. The period counter 42 is an example of a measuring unit configured to measure the time interval in the first signal. The identifying unit may be configured to identify the reflective surface used for scanning the first photosensitive member on a basis of the time interval in the first signal measured by the measuring unit and the information stored in the third storage unit. A first detection unit may to detect a change of the first signal from the first level to the second level. The identifying unit may update a first surface information indicating the reflective surface used for scanning the first photosensitive member each time the change is detected by the first detection unit. The first correction unit may correct the image data corresponding to the image to be formed on the first photosensitive member on a basis of the first surface information. The memory 43 may store information relating to a time interval between a first timing when the second signal changes from the first level to the second level and a second timing when the second signal changes from the first level to the second level, the second timing being a next timing of the first timing, and, the information being preliminarily acquired. The measuring unit measures the time interval in the second signal. The identifying unit may be configured to identify the reflective surface used for scanning the second photosensitive member on a basis of the time interval in the second signal measured by the measuring unit and the information stored in the third storage unit. A second detection unit may detect a change of the second signal from the first level to the second level. The identifying unit may update a second surface information indicating the reflective surface used for scanning the second photosensitive member each time the change is detected by the second detection unit. The second correction unit may correct the image data corresponding to the image to be formed on the second photosensitive member on a basis of the second surface information.

The surface counter 34Y is an example of a first counter that counts an identification number indicating the reflective surface reflecting light from the light source in the first rotating polygonal mirror, and updates the count value indicating the identification number each time the first signal is input. The image output circuit 35Y includes a first determination unit (e.g., the determination unit 52) that determines correction information on the basis of the count value of the first counter. The correction information may be correction data used for correcting image data corresponding to the image to be formed on the first photosensitive member. The image output circuit 35Y includes a first correction unit (e.g., the correction unit 53) that corrects image data for the first photosensitive member that is supplied to the light source on the basis of the correction information. Correction values for the writing position and the magnification correction have been determined for each reflective surface at factory shipment. Accordingly, the ROM of the image output circuit 35 or the memory 43 stores these correction values in association with the surface number. Thus, the reflective surface is correctly identified, and as a result, a correct correction value is applied. As a result, distortion and color shifting of images are reduced.

The setting unit 45 is an example of a setting unit that sets, to the first counter, an identification number (e.g., the surface number) of the reflective surface identified on the basis of the time measured by the measuring unit and the length information stored in the storage unit. The number designation unit 46 is an example of a notification unit that notifies the identification number of the reflective surface. The trigger unit 47 is an example of an output unit that outputs a setting signal that prompts setting of the identification number notified by the notification unit to the first counter.

The memory 43 stores information relating to the length of each of the plurality of plurality of reflective surfaces in the rotational direction of the second rotating polygonal mirror, the information preliminarily acquired for each of the plurality of reflective surfaces of the first rotating polygonal mirror. The period counter 42 measures the time from the falling edge to the next falling edge of the second signal selected by the selecting unit. That is, a single period of the second signal is measured. The surface determination unit 44 may identify the reflective surface reflecting light from the light source in the second rotating polygonal mirror on the basis of the time measured by the measuring unit and the information relating to the length of each of the reflective surfaces of the second rotating polygonal mirror stored in the storage unit. The lengths of the reflective surfaces of the second rotating polygonal mirror are different from each other.

The surface counter 34Y is an example of a second counter that counts an identification number indicating the reflective surface reflecting light from the light source in the second rotating polygonal mirror, and updates a count value indicating the identification number each time the second signal is input. The image output circuit 35Y includes a second determination unit that determines correction information on the basis of the count value of the second counter, and a second correction unit that corrects image data for the second photosensitive member supplied to the light source on the basis of the correction information.

As illustrated in FIG. 1, the first photosensitive member (e.g., the photosensitive members 108Y and 108C) is located upstream of the second photosensitive member (e.g., the photosensitive members 108M and 108K) in the rotational direction of the intermediate transfer member. Therefore, the reflective surface for the first photosensitive member is identified first, and as a result, image formation can be efficiently performed.

The identifying circuit 33 identifies, from among the plurality of reflective surfaces of the second rotating polygonal mirror, the reflective surface reflecting light from the light source on the basis of the second signal in a predetermined time period. The predetermined time period is a period from the start timing of the writing of the electrostatic latent image with light from the light source on the first photosensitive member to the start timing of the writing of the electrostatic latent image with light from the light source on the second photosensitive member. This period matches the transfer period during which the toner image is transported from the transfer position to the intermediate transfer member by the upstream photosensitive member to the transfer position to the intermediate transfer member by the downstream photosensitive member. Thus, the surface identification of the downstream photosensitive member is completed within the predetermined time period, and as a result, the generation of the toner image by the downstream photosensitive member is not delayed.

The light source 20Y is an example of a first light source. The light source 20M is an example of a second light source. In FIGS. 2, 3, and the like, Y (yellow) given at the end of the reference number may be replaced with C (cyan), and M (magenta) may be replaced with K (black). The polygon mirror 23 for cyan is an example of a rotatable third polygonal mirror including a plurality of reflective surfaces that reflect light output from a third light source, and the third polygonal mirror is configured such that light reflected by the third polygonal mirror scans the third photosensitive member with rotation of the third polygonal mirror. The light source 20 for cyan is an example of the third light source. The BD sensor 24 for cyan is an example of a third detecting unit that is scanned by light reflected by the third polygonal mirror with rotation of the third polygonal mirror, and outputs a third detection signal when the light is incident on the unit.

The light source 20 for black is an example of a fourth light source. The polygon mirror 23 for black is an example of a rotatable fourth polygonal mirror including a plurality of reflective surfaces that reflect light output from the fourth light source, and the fourth polygonal mirror is configured such that light reflected by the fourth polygonal mirror scans a fourth photosensitive member with rotation of the fourth polygonal mirror. The BD sensor 24 for black is an example of a fourth detecting unit that is scanned by light reflected by the fourth polygonal mirror with rotation of the fourth polygonal mirror, and outputs a fourth detection signal when the light is incident on the unit.

The surface identifying unit 31 for yellow and magenta is an example of a first identifying unit. The surface identifying unit 31 for cyan and black is an example of a second identifying unit provided to be shared for the third detection signal and the fourth detection signal. The second identifying unit identifies the reflective surface reflecting light from the third light source among the plurality of reflective surfaces of the third polygonal mirror on the basis of the third detection signal, and identifies the reflective surface reflecting light from the fourth light source among the plurality of reflective surfaces of the fourth polygonal mirror on the basis of the fourth detection signal.

As illustrated in FIG. 1, in the rotational direction of the intermediate transfer member, the first photosensitive member may be located upstream of the second photosensitive member, the second photosensitive member may be located upstream of the third photosensitive member, and the third photosensitive member may be located upstream of the fourth photosensitive member.

As illustrated in FIG. 1, the image forming apparatus 100 includes the optical scanning apparatuses 107YM and 107CK. The developer 110 is an example of a developing unit that forms a toner image by developing a latent electrostatic image formed by the optical scanning apparatus with a toner. The primary transfer unit 112, the intermediate transfer belt 111, and the secondary transfer rollers 114 and 116 are examples of a transfer unit that transfers toner images to the sheet P. The fixing apparatus 124 is an example of a fixing unit that fixes a toner image to the sheet P.

The light source 20, the polygon mirror 23, the photosensitive member 108, the BD sensor 24, and the motor control unit 29Y in the embodiment are included in the image forming unit.

In addition, while the surface number is identified based on the time interval of adjacent pulses of the BD signal in this embodiment, the method for identifying the surface number is not limited thereto. For example, the surface number may be identified based on a phase difference between a BD signal and a signal (e.g., an encoder signal, an FG signal, or the like) indicating the rotation period of a motor that drives the polygon mirror 23 into rotation.

Figure 9:
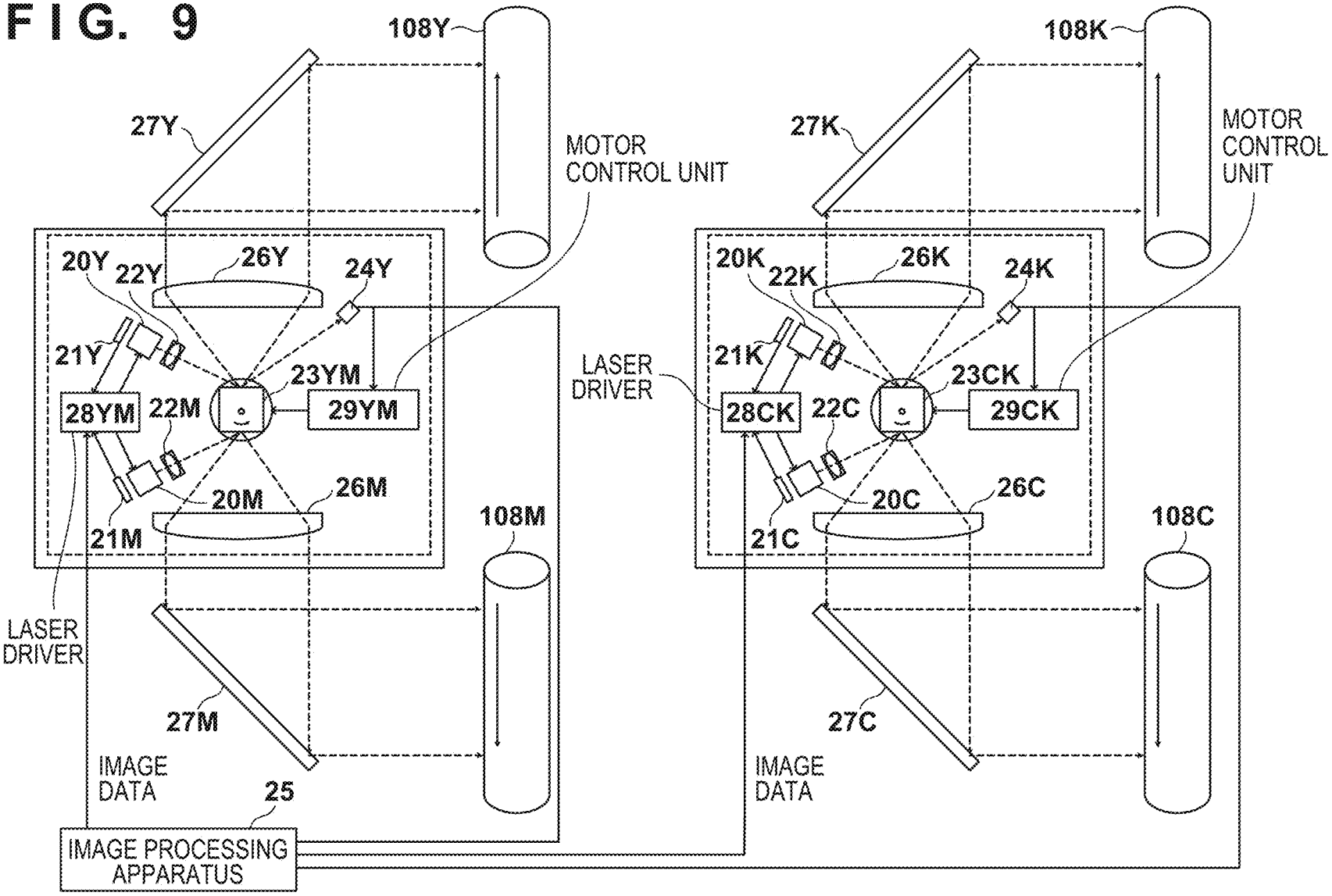
FIG. 9 is a drawing for describing the optical scanning apparatus.

In the present embodiment, the polygon mirror 23 and the BD sensor 24 are provided for each of Y, M, C, and K in the image forming apparatus 100. That is, while four polygon mirrors 23 and four BD sensors 24 are provided in the image forming apparatus 100, the present invention is not limited thereto. For example, as illustrated in FIG. 9, the polygon mirror 23 and the BD sensor 24 may be provided for each of a pair of YM and a pair of CK in the image forming apparatus 100. That is, a configuration may be adopted in which two polygon mirrors 23 and two BD sensors 24 are provided in the image forming apparatus 100. A laser driver 28YM drives the light sources 20Y and 20M. A polygon mirror 23YM deflects the laser light from the light source 20Y and deflects the laser light from the light source 20M. A motor control unit 29YM controls a motor that drives the polygon mirror 23YM. A laser driver 28CK drives light sources 20K and 20C. A polygon mirror 23CK deflects the laser light from the light source 20C and deflects the laser light from the light source 20K. A motor control unit 29CK controls a motor that drives the polygon mirror 23CK. In this configuration, the image processing apparatus 25 performs surface identification on the basis of a sensor 24CK relating to CK after performing surface identification on the basis of a BD sensor 24YM relating to YM. Note that the surface number of the reflective surface that deflects the laser light from the light source 20Y and the surface number of the reflective surface that deflects the laser light from the light source 20M are different from each other by a predetermined value at all times. Thus, when the surface number of the reflective surface that deflects the laser light from the light source 20Y is identified, the surface number of the reflective surface that deflects the laser light from the light source 20M is identified by adding a predetermined value to the surface number of the reflective surface that deflects the laser light from the light source 20Y. Likewise, the surface number is identified for CK. Note that in this configuration, for example, the photosensitive member corresponding to Y corresponds to the first photosensitive member, and the photosensitive member corresponding to C corresponds to the second photosensitive member.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-180939, filed Sep. 26, 2018 which is hereby incorporated by reference herein in its entirety.

What is claimed is:

1. An information processing apparatus connectable to an image forming apparatus comprising an image forming unit, wherein the image forming unit comprises:

a first photosensitive member configured to carry a toner image of a first color;

a first transfer unit configured to transfer the toner image of the first color formed on the first photosensitive member to an intermediate transfer member;

a first light source configured to output light on a basis of image data of the first color;

a first rotating polygonal mirror including a plurality of reflective surfaces and configured to scan the first photosensitive member by rotating to deflect the light output from the first light source by the plurality of reflective surfaces;

a first light receiving unit configured to receive the light deflected by the first rotating polygonal mirror;

a first output unit configured to output a first signal in response to reception of the light by the first light receiving unit, the first signal having a first level and a second level;

a second photosensitive member provided downstream of the first photosensitive member in a rotational direction in which the intermediate transfer member rotates, and configured to carry a toner image of a second color;

a second light source configured to output light on a basis of image data of the second color;

a second rotating polygonal mirror including a plurality of reflective surfaces and configured to scan the second photosensitive member by rotating to deflect the light output from the second light source by the plurality of reflective surfaces;

a second light receiving unit configured to receive the light deflected by the second rotating polygonal mirror; and a second output unit configured to output a second signal in response to reception of the light by the second light receiving unit, the second signal having the first level and the second level;

wherein the information processing apparatus comprises:

an identifying unit configured to identify a reflective surface used for scanning the first photosensitive member from among the plurality of reflective surfaces of the first rotating polygonal mirror on a basis of the first signal, and to identify a reflective surface used for scanning the second photosensitive member from among the plurality of reflective surfaces of the second rotating polygonal mirror on a basis of the second signal, wherein the identifying unit identifies the reflective surface used for scanning the second photosensitive member after identifying the reflective surface used for scanning the first photosensitive member;

a first storage unit configured to store a plurality of pieces of correction data each of which corresponds to a different one of the plurality of reflective surfaces of the first rotating polygonal mirror;

a first correction unit configured to correct, on a basis of the correction data stored in the first storage unit and information indicating the reflective surface identified by the identifying unit, image data of the first color in association with the reflective surface to adjust a position of the toner image on the first photosensitive member;

a third output unit configured to output the image data corrected by the first correction unit to the image forming unit;

a second storage unit configured to store a plurality of pieces of correction data each of which corresponds to a different one of the plurality of reflective surfaces of the second rotating polygonal mirror;

a second correction unit configured to correct, on a basis of the correction data stored in the second storage unit and information indicating the reflective surface identified by the identifying unit, image data of the second color in association with the reflective surface to adjust a position of the toner image on the second photosensitive member; and a fourth output unit configured to output the image data corrected by the second correction unit to the image forming unit.

2. The information processing apparatus according to claim 1, wherein the first photosensitive member is provided such that the first photosensitive member is adjacent to the second photosensitive member.

3. The information processing apparatus according to claim 1, wherein the first color is yellow and the second color is magenta.

4. The information processing apparatus according to claim 1, wherein the identifying unit is configured to identify the reflective surface used for scanning the first photosensitive member from among the plurality of reflective surfaces of the first rotating polygonal mirror on the basis of the first signal by selecting the first signal from the first signal and the second signal, and identify the reflective surface used for scanning the second photosensitive member from among the plurality of reflective surfaces of the second rotating polygonal mirror on the basis of the second signal by selecting the second signal from the first signal and the second signal.

5. The information processing apparatus according to claim 1, further comprising:

a third storage unit configured to store information relating to a time interval between a first timing when the first signal changes from the first level to the second level and a second timing when the first signal changes from the first level to the second level, the second timing being a next timing of the first timing, and the information being preliminarily acquired; and a measuring unit configured to measure the time interval in the first signal;

wherein the identifying unit is configured to identify the reflective surface used for scanning the first photosensitive member on a basis of the time interval in the first signal measured by the measuring unit and the information stored in the third storage unit.

6. The information processing apparatus according to claim 1, further comprising a first detection unit configured to detect a change of the first signal from the first level to the second level, wherein the identifying unit updates a first surface information indicating the reflective surface used for scanning the first photosensitive member each time the change is detected by the first detection unit; and wherein the first correction unit corrects the image data corresponding to the image to be formed on the first photosensitive member on a basis of the first surface information.

7. The information processing apparatus according to claim 1, wherein a circuit board on which the identifying unit is provided is a circuit board different from a circuit board on which the first output unit and the second output unit are provided; and wherein the circuit board on which the identifying unit is provided is connected, by a cable, to the circuit board on which the first output unit and the second output unit are provided.

8. The information processing apparatus according to claim 5, wherein the third storage unit is configured to store information relating to a time interval between a first timing when the second signal changes from the first level to the second level and a second timing when the second signal changes from the first level to the second level, the second timing being a next timing of the first timing, and, the information being preliminarily acquired;

wherein the measuring unit measures the time interval in the second signal;

wherein the identifying unit is configured to identify the reflective surface used for scanning the second photosensitive member on a basis of the time interval in the second signal measured by the measuring unit and the information stored in the third storage unit.

9. The information processing apparatus according to claim 6, further comprising a second detection unit configured to detect a change of the second signal from the first level to the second level, wherein the identifying unit updates a second surface information indicating the reflective surface used for scanning the second photosensitive member each time the change is detected by the second detection unit, and wherein the second correction unit corrects the image data corresponding to the image to be formed on the second photosensitive member on a basis of the second surface information.

10. The information processing apparatus according to claim 1, wherein the identifying unit identifies the reflective surface used for scanning the second photosensitive member from among the plurality of reflective surfaces of the second rotating polygonal mirror on the basis of the second signal in a time period from a timing at which writing of the image of the first color with light from the first light source on the first photosensitive member is started to a timing at which writing of the image of the second color with light from the second light source on the second photosensitive member is started.

11. An image forming apparatus comprising a generating unit configured to generate image data; and an image forming unit configured to perform image formation on a recording medium on a basis of the image data output from the generating unit, wherein the image forming unit comprises:

a first photosensitive member configured to carry a toner image of a first color;

a first transfer unit configured to transfer the toner image of the first color formed on the first photosensitive member to an intermediate transfer member;

a first light source configured to output light on a basis of image data of the first color;

a first rotating polygonal mirror including a plurality of reflective surfaces and configured to scan the first photosensitive member by rotating to deflect the light output from the first light source by the plurality of reflective surfaces;

a first light receiving unit configured to receive the light deflected by the first rotating polygonal mirror;

a first output unit configured to output a first signal in response to reception of the light by the first light receiving unit, the first signal having a first level and a second level;

a second photosensitive member provided downstream of the first photosensitive member in a rotational direction in which the intermediate transfer member rotates, and configured to carry a toner image of a second color;

a second light source configured to output light on a basis of image data of the second color;

a second rotating polygonal mirror including a plurality of reflective surfaces and configured to scan the second photosensitive member by rotating to deflect the light output from the second light source by the plurality of reflective surfaces;

a second light receiving unit configured to receive the light deflected by the second rotating polygonal mirror; and a second output unit configured to output a second signal in response to reception of the light by the second light receiving unit, the second signal having the first level and the second level; and wherein the generating unit comprises:

an identifying unit configured to identify a reflective surface used for scanning the first photosensitive member from among the plurality of reflective surfaces of the first rotating polygonal mirror on a basis of the first signal, and to identify a reflective surface used for scanning the second photosensitive member from among the plurality of reflective surfaces of the second rotating polygonal mirror on a basis of the second signal, wherein the identifying unit identifies the reflective surface used for scanning the second photosensitive member after identifying the reflective surface used for scanning the first photosensitive member;

a first storage unit configured to store a plurality of pieces of correction data each of which corresponds to a different one of the plurality of reflective surfaces of the first rotating polygonal mirror;

a first correction unit configured to correct, on a basis of the correction data stored in the first storage unit and information indicating the reflective surface identified by the identifying unit, image data of the first color in association with the reflective surface to adjust a position of the toner image on the first photosensitive member;

a third output unit configured to output the image data corrected by the first correction unit to the image forming unit;

a second storage unit configured to store a plurality of pieces of correction data each of which corresponds to a different one of the plurality of reflective surfaces of the second rotating polygonal mirror;

a second correction unit configured to correct, on a basis of the correction data stored in the second storage unit and information indicating the reflective surface identified by the identifying unit, image data of the second color in association with the reflective surface to adjust a position of the toner image on the second photosensitive member; and a fourth output unit configured to output the image data corrected by the second correction unit to the image forming unit.

12. The information processing apparatus according to claim 1, wherein the first correction unit corrects the image data by correcting a write start timing of light outputted from the first light source to the first photosensitive member, and the second correction unit corrects the image data by correcting a write start timing of light outputted from the second light source to the second photosensitive member.

13. The information processing apparatus according to claim 1, wherein the image forming unit comprises:

a third photosensitive member provided downstream of the second photosensitive member in the rotational direction, and configured to carry a toner image of a third color;

a third transfer unit configured to transfer the toner image of the third color formed on the third photosensitive member to the intermediate transfer member;

a third light source configured to output light on a basis of image data of the third color;

a third rotating polygonal mirror including a plurality of reflective surfaces and configured to scan the third photosensitive member by rotating to deflect the light output from the third light source by the plurality of reflective surfaces;

a third light receiving unit configured to receive the light deflected by the third rotating polygonal mirror;

a third output unit configured to output a third signal in response to reception of the light by the third light receiving unit, the third signal having the first level and the second level;

a fourth photosensitive member provided downstream of the third photosensitive member in the rotational direction, and configured to carry a toner image of a fourth color;

a fourth transfer unit configured to transfer the toner image of the fourth color formed on the fourth photosensitive member to the intermediate transfer member;

a fourth light source configured to output light on a basis of image data of the fourth color;

a fourth rotating polygonal mirror including a plurality of reflective surfaces and configured to scan the fourth photosensitive member by rotating to deflect the light output from the fourth light source by the plurality of reflective surfaces;

a fourth light receiving unit configured to receive the light deflected by the fourth rotating polygonal mirror; and a fourth output unit configured to output a fourth signal in response to reception of the light by the fourth light receiving unit, the fourth signal having the first level and the second level, wherein the identifying unit is configured to identify a reflective surface used for scanning the third photosensitive member from among the plurality of reflective surfaces of the third rotating polygonal mirror on a basis of the third signal, and to identify a reflective surface used for scanning the fourth photosensitive member from among the plurality of reflective surfaces of the fourth rotating polygonal mirror on a basis of the fourth signal, the identifying unit identifying the reflective surface used for scanning the third photosensitive member after identifying the reflective surface used for scanning the second photosensitive member, and the identifying unit identifying the reflective surface used for scanning the fourth photosensitive member after identifying the reflective surface used for scanning the third photosensitive member.

* * * * *